US008792658B2

(12) United States Patent
Baliga et al.

(10) Patent No.: US 8,792,658 B2
(45) Date of Patent: Jul. 29, 2014

(54) TECHNIQUES FOR PROTECTION OF ACOUSTIC DEVICES

(75) Inventors: Shankar B. Baliga, Irvine, CA (US); Scott W. Reed, Rancho Santa Margarita, CA (US); John G Romero, Rancho Santa Margarita, CA (US)

(73) Assignee: General Monitors, Inc., Lake Forest, CA (US)

( * ) Notice: Subject to any disclaimer, the term of this patent is extended or adjusted under 35 U.S.C. 154(b) by 1709 days.

(21) Appl. No.: 11/847,615

(22) Filed: Aug. 30, 2007

(65) Prior Publication Data

US 2009/0060246 A1 Mar. 5, 2009

(51) Int. Cl.
*H04R 25/00* (2006.01)

(52) U.S. Cl.
USPC ..... 381/189; 381/354

(58) Field of Classification Search
USPC ..... 381/189, 354
See application file for complete search history.

(56) References Cited

U.S. PATENT DOCUMENTS

| | | | | |
|---|---|---|---|---|
| 3,497,638 | A | 2/1970 | Cohen | |
| 4,455,863 | A * | 6/1984 | Huebler et al. | 73/40.5 A |
| 5,612,930 | A * | 3/1997 | Hazony et al. | 367/140 |
| 6,812,620 | B2 * | 11/2004 | Scheeper et al. | 310/324 |
| 7,938,223 | B2 * | 5/2011 | Slack | 181/152 |
| 2005/0077102 | A1 * | 4/2005 | Banter et al. | 181/149 |
| 2006/0045302 | A1 * | 3/2006 | Akino et al. | 381/355 |
| 2006/0125348 | A1 * | 6/2006 | Smith et al. | 310/309 |
| 2006/0191341 | A1 * | 8/2006 | Olesen et al. | 73/592 |
| 2006/0192966 | A1 * | 8/2006 | Moeckli et al. | 356/437 |
| 2006/0254340 | A1 * | 11/2006 | Baraket et al. | 73/24.01 |
| 2007/0089481 | A1 * | 4/2007 | Wansing | 73/23.2 |

FOREIGN PATENT DOCUMENTS

EP 1 522 839 B1 8/2003

OTHER PUBLICATIONS

JL World, Memstech, PosiSound Series, Integrated Silicon Microphone, Document #: DS-SMIC-MSM2RM-S3035.Rev A, undated, pp. 1-7.
Infineon, Target Data Sheet Version 3.3, Surface Mount Microphone, SMM310, Jan. 30, 2007, 5 pages.
Knowles Acoustics, Data Sheet, SP0102BE3, "Zero Height" SiSonic TM Microphone Specification, Revision: B, 2004-2005, 10 pages.
Knowles Acoustics, Data Sheet, SPM0102ND3, Mini SiSoic TM Microphone Specification, Revision C, 2005, 10 pages.
CSA C22.2 No. 30-M1986 from the Canadian Standards Association, Explosion-Proof Enclosures for Use in Class 1 Hazardous Locations, 1986, 42 pages.
International Standard 60079-1, Fifth Edition, 2003, Electrical Apparatus for Explosive Gas Environments, Part 1, Flameproof Enclosures "d", 144 pages.
Approval Standard for Electric Equipment for use in Hazardous (Classified) Locations General Requirements, Class No. 3600, Nov. 1998, 14 pages.
Approval Standard for Explosionproof Electrical Equipment General Requirements, Class No. 3615, Aug. 2006, 33 pages.
SPE-Product Specification, TC 200Z11 A-v0l, 2006, 5 pages.

* cited by examiner

*Primary Examiner* — Benjamin Sandvik
(74) *Attorney, Agent, or Firm* — Larry K. Roberts

(57) ABSTRACT

An exemplary embodiment of an acoustic sensor system includes a housing structure, and a miniaturized acoustic transducer mounted in the housing structure. A flame arrestor structure is mounted on or within the housing structure between the acoustic transducer and the external environment, so that ambient acoustic energy passes through the flame arrestor structure before reaching the acoustic transducer.

23 Claims, 5 Drawing Sheets

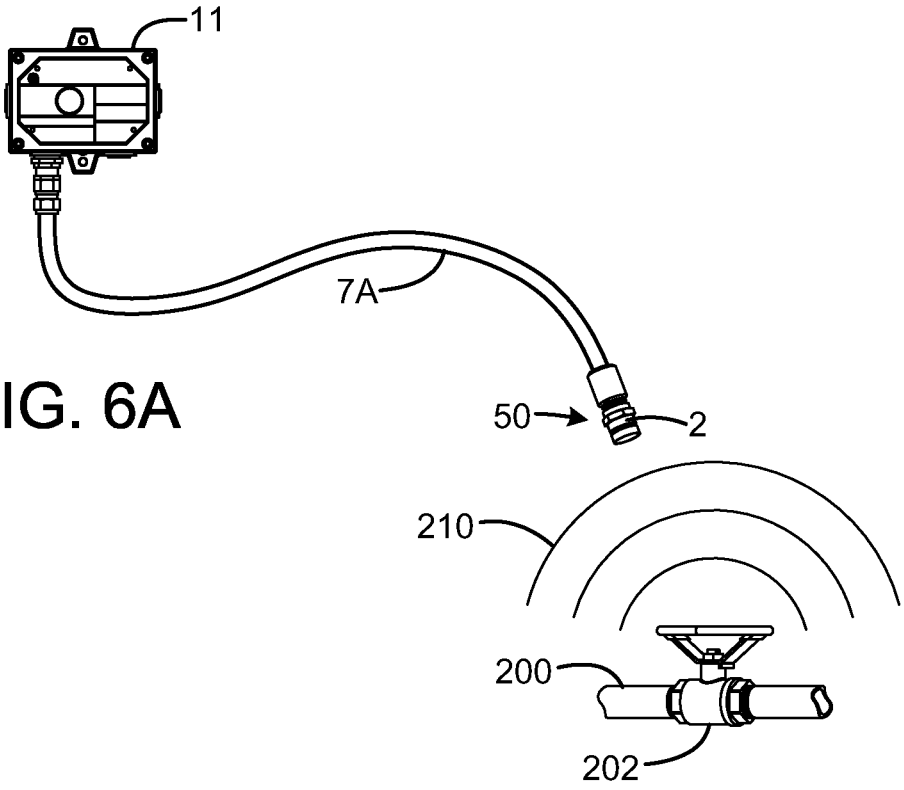
FIG. 6A
FIG. 7
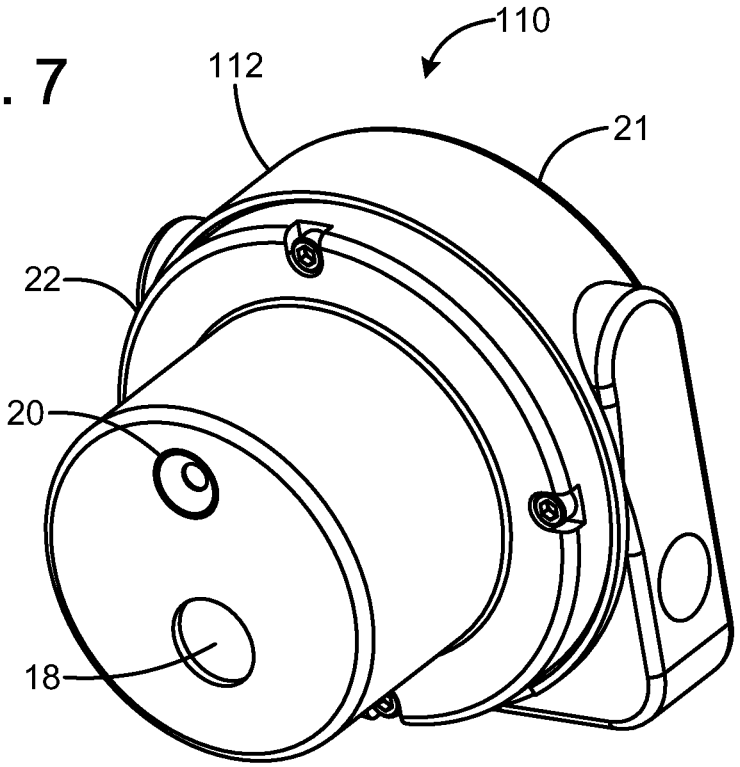

TECHNIQUES FOR PROTECTION OF ACOUSTIC DEVICES

BACKGROUND

An accepted method of protection for industrial sensors such as fire and gas detectors in North America is the explosion proof method, known as XP, which ensures that any explosive condition is contained within the sensor enclosure, and does not ignite the surrounding environment. In Europe, the term "flame proof," known as Ex d, is used for an equivalent method and level of protection: in this description, the terms "explosion proof" and "flame proof" are used synonymously to avoid global variations in terminology. Explosion proof sensors have utility in many applications, including those involving toxic or flammable gases or liquids, and high pressure gas systems. There are established standards for explosion proof or flame proof systems, and systems can be certified to meet these standards. Some of the standards that are widely accepted by the industry and government regulatory bodies for explosion-proof or flame-proof design are CSA C22.2 No. 30-M1986 from the Canadian Standards Association, FM 3600 and 3615 from Factory Mutual, and IEC 60079-0 and 60079-1 from the International Electrotechnical Commission.

BRIEF DESCRIPTION OF THE DRAWINGS

FIG. 6A is a diagrammatic view of an exemplary embodiment of a remotely-mounted acoustic sensor.

FIG. 7 is an isometric view illustrating an exemplary embodiment of an acoustic system employing an explosion proof acoustic device integrated with an electronics package.

DETAILED DESCRIPTION

Figure 1:
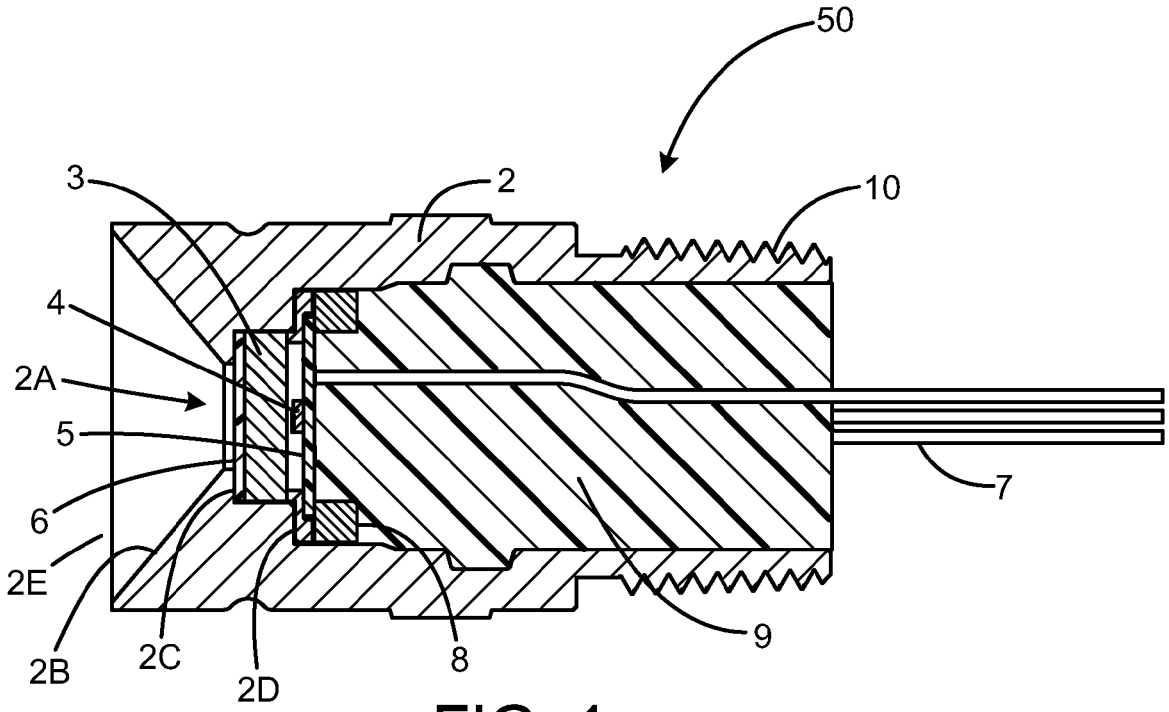
FIG. 1 is a cross-sectional view of an exemplary embodiment of an acoustic system employing a flame arrestor with a miniature microphone as an acoustic device.

In the following detailed description and in the several figures of the drawing, like elements are identified with like reference numerals. The figures are not to scale, and relative feature sizes may be exaggerated for illustrative purposes.

Techniques are described for mounting an acoustic device or transducer such as a miniature microphone or speaker in a housing. In some exemplary embodiments, the arrangement provides an acoustic system adapted for operation in an explosive, hazardous environment. In an exemplary embodiment, the acoustic transducer includes a microphone which detects sound pressure waves that have passed through a flame arrestor. The microphone housing may be mounted remotely or attached to another housing that contains the embedded electronics which convert the sound pressure to an electrical signal for transmission to the user or for visual display. In another embodiment, an acoustic source may be mounted in a housing for operation in an explosive, hazardous environment. In an exemplary embodiment, the explosion proof miniature microphone is utilized as an ultrasonic gas leak detector.

In an exemplary embodiment, a miniature microphone based on MEMS (Micro Electro Mechanical Systems) technology can be operated out to 100 kHz in the ultrasonic range. To use a MEMS microphone in an industrial application, the microphone may be suitably packaged for operation in a hazardous location. In an exemplary embodiment, a flame arrestor may be utilized as a protective element in front of the sensing element. An exemplary embodiment of the flame arrestor prevents the transmission of ignited flames or explosions, while permitting the flow of acoustic energy.

FIGS. 1-4 illustrate various exemplary embodiments of explosion proof acoustic systems, which include an acoustic transducer such as a microphone. The acoustic systems may be adapted for operation in an ultrasonic frequency range, for some exemplary applications, or for operation in audible frequencies for some applications. These exemplary embodiments of acoustic systems each includes a housing 2, which in an exemplary embodiment may be fabricated from aluminum, stainless steel or other industrial metal with suitable tensile strength. The housing 2 in these examples may take a generally cylindrically configuration, with a hollow open interior space. The external surface and the internal surface of the housing may be machined or fabricated with various shoulders and step surfaces, and the outer surface may include a threaded portion. For example, the system 50 depicted in FIG. 1 includes a housing 2 with a hollow interior space generally depicted as 2A. At the transducer end 2E of the housing, the hollow interior space is formed by a chamfer or lead-in 2B, and provides a port or window for acoustic energy to impact a transducer mounted in the housing. The interior hollow or open area 2A of the housing may be fabricated with support shoulder surfaces 2C and 2D, which may register the positions of particular elements of the system 50.

FIG. 1 illustrates an exemplary acoustic system 50, which includes a porous metal sintered disc 3, which in an exemplary embodiment may be made of type 316L stainless steel. The disc 3 is disposed on the front or transducer end 2E of the housing 2, registered in position by shoulder 2C, and acts as a flame arrestor. The sintered disc 3 can be press fitted into the housing, attached to the housing, or fabricated integral to the housing. This latter approach may be used if the sinter and housing material are both stainless steel. In an exemplary embodiment, the sintered metal disc 3 may be an eighth of an inch thick, with maximum pore size of 250 microns, which is known from the design guidelines and tests of governing agency bodies to meet the requirements for an Ex d protection method. An exemplary disc diameter is 0.5 inch. An acoustic device or transducer 4 is mounted on the front side of a circuit board 5 and placed close to but not in contact with the sintered metal disc; an exemplary spacing distance between the disc and the transducer is 0.015 inch. These dimensions are exemplary; other embodiments and applications may employ elements of different dimensions. For example, the circuit board 5 may be registered in position within the housing by the shoulder surface 2D. In an exemplary embodiment, the acoustic device 4 may include a miniaturized microphone, e.g., a MEMS microphone.

For operation of the microphone in humid environments, a hydrophobic membrane 6 can be placed between the sintered disc 3 and the external environment. The membrane 6 may be selected for its excellent acoustic transmission properties; an example of such a membrane is SEFAR PETEX 07-41/14, manufactured by SEFAR of That, Switzerland. Other membranes suitable for the purpose are manufactured by W.L. Gore & Associates, Inc. of Elkton, Md.

The porosity and thickness of the sintered metal disc is preferably selected such that the disc does not significantly degrade the transmission of acoustic sound waves of the desired frequency range to the microphone, e.g., ultrasonic frequencies. The sintered disc 3 thereby not only provides protection for operation in a hazardous environment, but also provides protection against dust and water while still permitting excellent acoustic sound wave transmission. The hydrophobic membrane 6 provides additional protection against the environment, if so desired. It also prevents dust and moisture from reaching the sintered metal disc 3, thereby preventing the porous metal disc from being clogged.

Still referring to FIG. 1, electrical wires 7 for bias, ground and signal lines for the acoustic transducer are routed off the circuit board 5 to the back of the housing. A typical bias voltage for a MEMS microphone is 2.5 V dc. A retainer 8 holds the assembly in place within the hollow region 2A of the housing, while the remaining portion of the hollow region housing 2 is sealed off from the rear using an electrically insulating potting compound 9. An example of an agency compliant potting compound suitable for the purpose is Stycast 2850 FT from Emerson & Cuming.

In an exemplary embodiment, the acoustic system 50 with an explosion proof microphone 4 may provide a complete sensor for ultrasonic sound detection. With the encapsulated back end and the sintered metal disc front end, it is suited for operation in an explosive hazardous location as either an individual sensor that is mounted remotely, or a sensor that is attached to, e.g. by thread engagement, into another housing that is also adapted for hazardous locations. The threads 10 on the housing 2 of system 50 enable the sensor housing to be screwed into such a second housing. For example, FIG. 6 depicts the sensor 50 of FIG. 1 mounted into a housing 11 that contains the electronics to condition and process the sensor microphone signals and subsequently generates outputs for the user.

Figure 6:
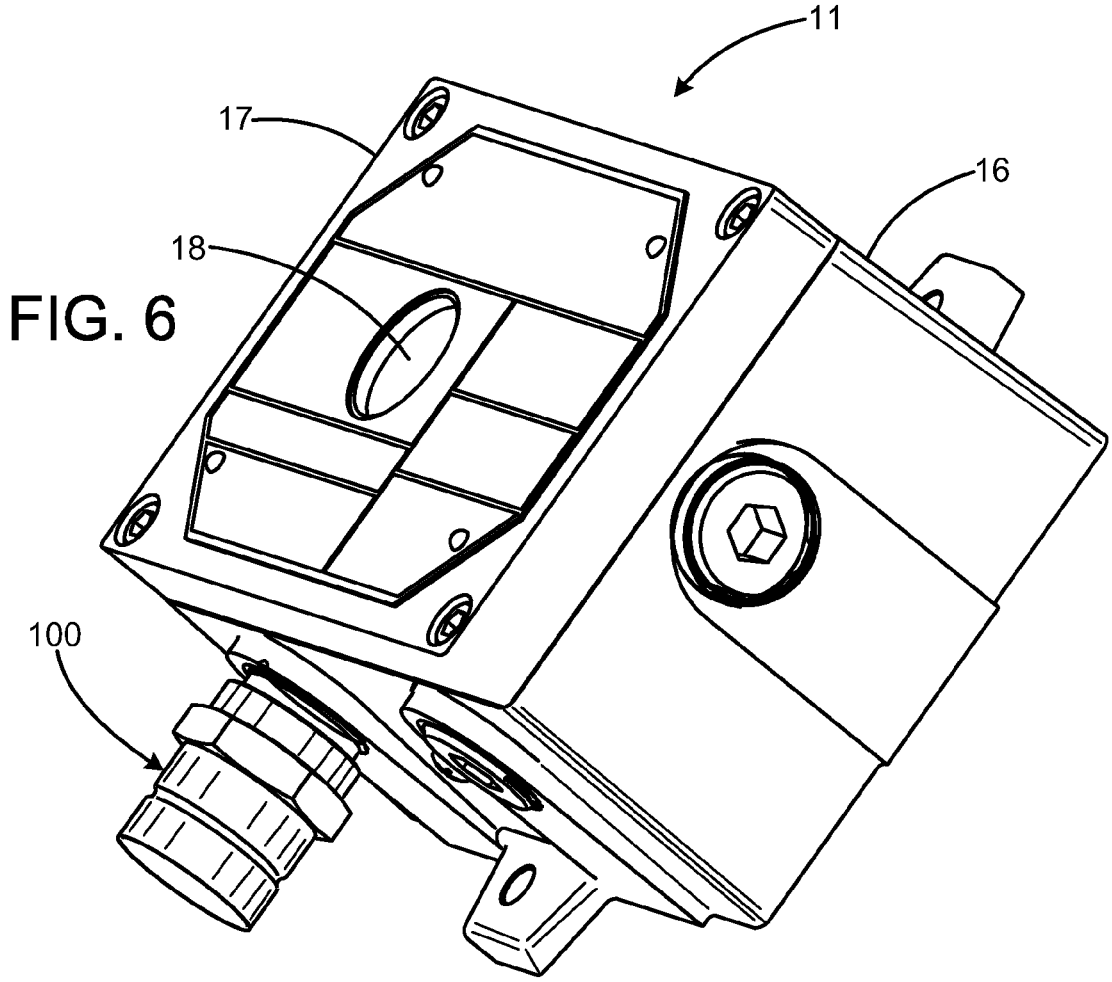
FIG. 6 is an isometric view of an exemplary embodiment of an explosion proof acoustic system mounted on a housing containing an electronics package.

The entire assembly of FIG. 6 is an exemplary embodiment of an ultrasonic detector that can be used to measure the ultrasonic emissions from high-pressure gas leaks and trigger an alarm. The common industry accepted means of communicating the ultrasonic measurement to the user are via a display, relays, analog output or digital communication such as Modbus or HART. These communication methods are well known to those in the automation and process industries, and specifically to those who work in plant safety for the oil and gas industry.

Figure 2:
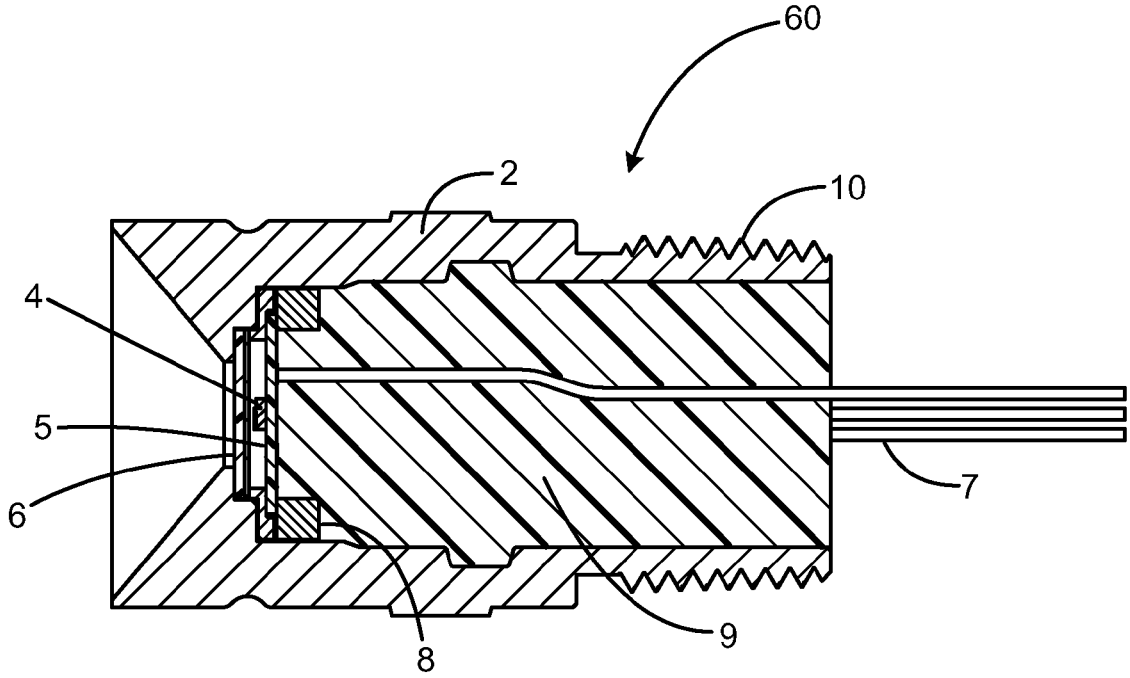
FIG. 2 is a cross-sectional view of an alternate exemplary embodiment of an acoustic system with a flame arrestor with a miniature microphone as an acoustic transducer.

Referring to FIG. 2, another embodiment of an acoustic system 60 is depicted. The system 60 employs a metal screen 12 as a flame arrestor. Metal screens have been accepted by several agencies as a flame arrestor. There is typically little change in microphone performance whether the sintered disc or screen is used. An exemplary embodiment of a screen that is acceptable as a flame arrestor and yet provides excellent ultrasonic sound wave transmission is a type 316 stainless steel weave filter cloth of nominal mesh count 280. As with the system 50 of FIG. 1, the screen flame arrestor may optionally be used in conjunction with the hydrophobic membrane 6.

The exemplary embodiments of FIGS. 1 and 2 both show the MEMS microphone 4 mounted on the front side of the circuit board 5 and facing the in-coming sound wave. Exemplary embodiments of MEMS microphones that may be mounted in such a manner are commercially available, and include the SiSonic™ Surface Mount Microphone from Knowles Acoustics of Itasca, Ill., the SiMic™ TC200Z11A Analog Silicon Condenser Microphone from Sonion Horsens A/S of Horsens, Denmark and the SMM310 Surface Mount Microphone from Infineon Technologies AG, of Munich, Germany.

Figure 3:
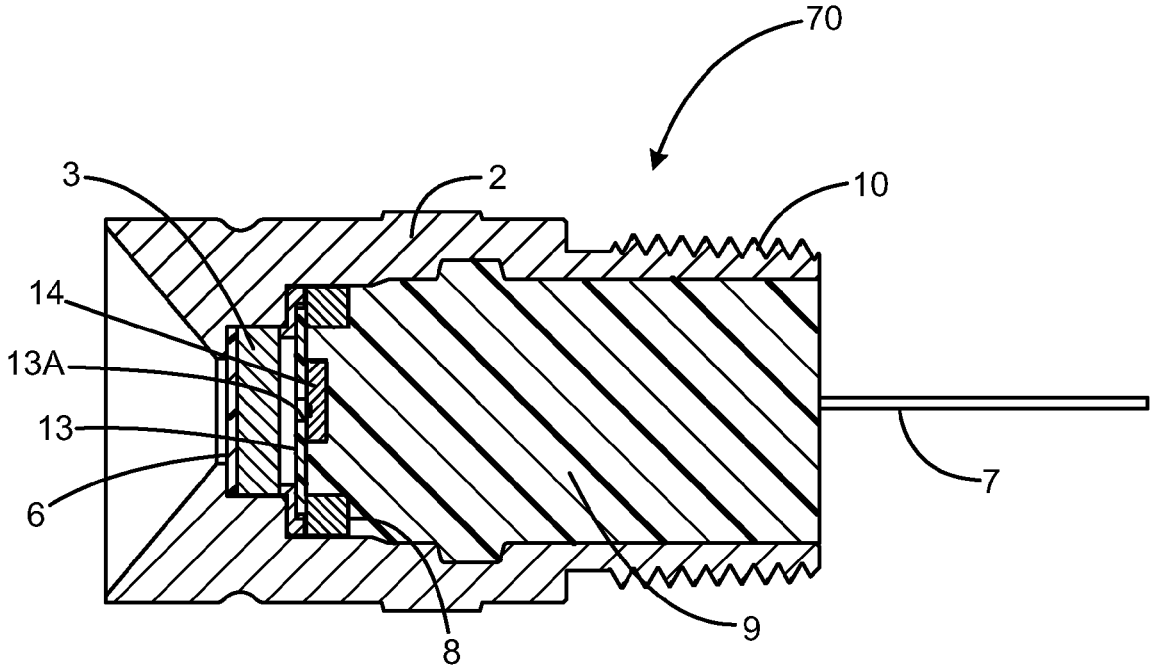
FIG. 3 is a cross-sectional view of yet another exemplary embodiment of an acoustic system with a flame arrestor.
Figure 4:
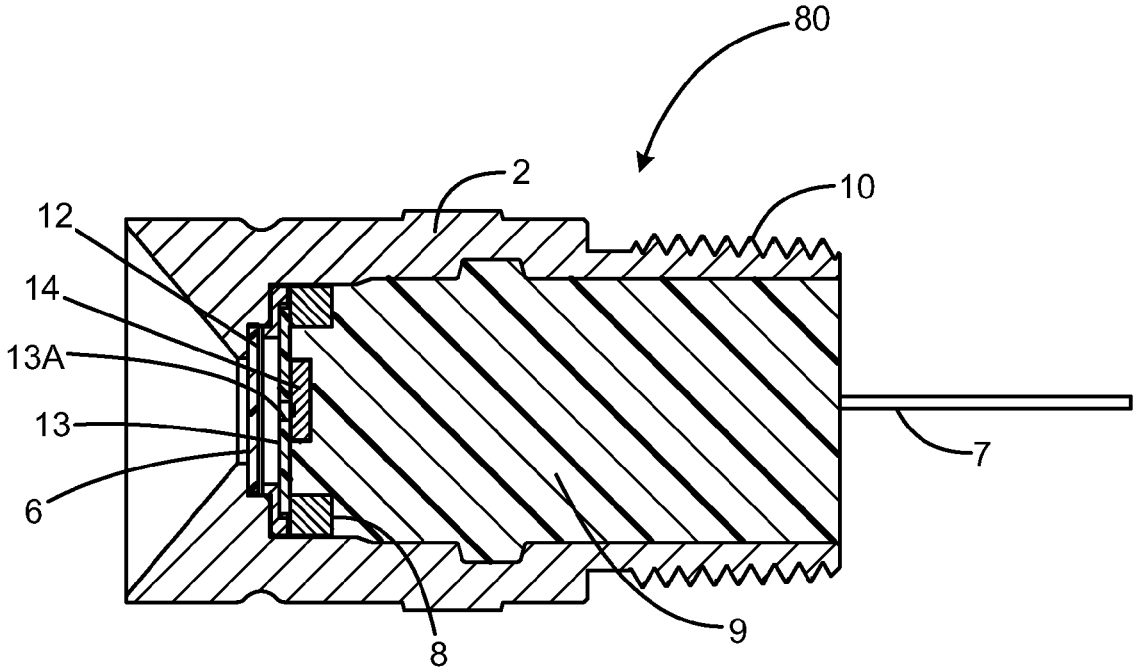
FIG. 4 is a cross-sectional view of a further exemplary embodiment of an acoustic system employing a flame arrestor.

FIG. 3 and FIG. 4 depict alternate embodiments of respective acoustic systems 70 and 80. The systems 70 and 80 employ another type of MEMS microphone 14 in the explosion proof housing 2, which is mounted on the back side of a circuit board 13, away from the flame arrestor 3. The microphone 14 receives sound energy through a hole 13A in the circuit board 13. The hole in the circuit board directs and controls the sound reaching the MEMS microphone mounted on the other side of the circuit board. An exemplary diameter of the hole is 1.4 mm, for one application. Such a microphone is known as "zero height" in the microphone nomenclature, as the microphone does not protrude above the circuit board. Exemplary MEMS microphones suitable for the purpose are commercially available, including for example the MSM2RM PosiSound Series MEMS microphone from MEMSTECH, Malaysia, and the SP0102BE3 Surface Mount Microphone from Knowles Acoustics, Itasca, Ill.

The system 70 of FIG. 3 illustrates the use of a sintered metal disc 3 with the microphone 14. The system 80 of FIG. 4 illustrates the use of a metal screen 12 with the microphone 14.

Figure 5:
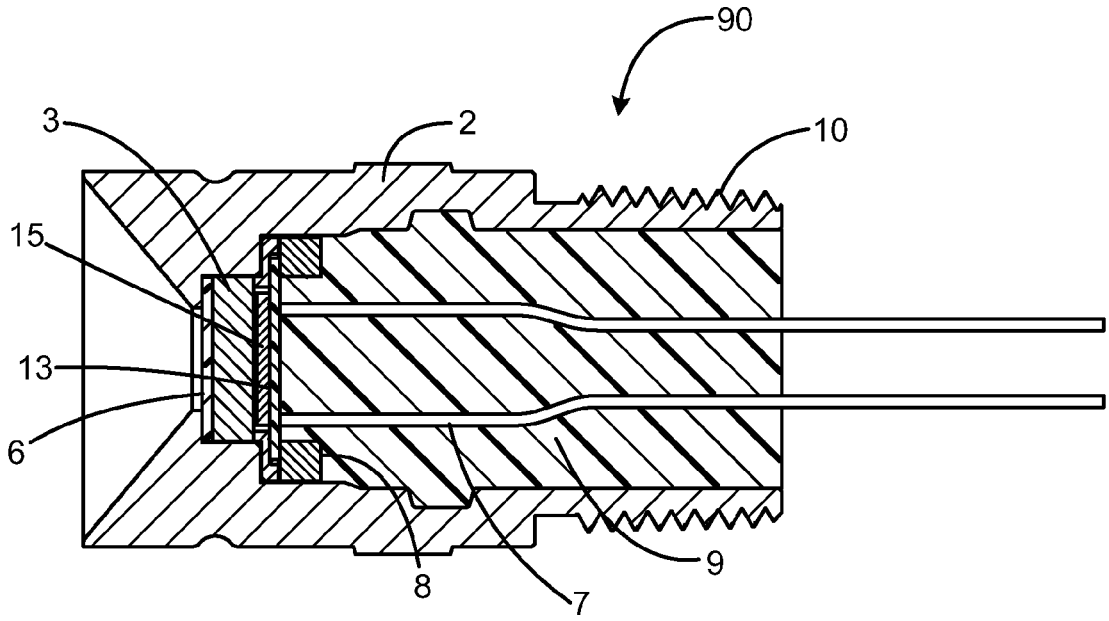
FIG. 5 is a cross-sectional view of an exemplary embodiment of an acoustic system with a flame arrestor with a miniature sound source as an acoustic transducer.

FIG. 5 illustrates another exemplary embodiment of an acoustic system 90. In this embodiment, the system employs as an acoustic device a miniature sound source or speaker 15, which is mounted for operation in an explosive hazardous environment. Since the sintered disc flame arrestor 3 of FIG. 1 and FIG. 3 may be chosen to allow sound transmission with reduced or minimal attenuation for sound detection, the same flame arrestor can be used to effectively transmit sound out of the housing. A screen type flame arrestor can also be used, as shown in FIG. 2 and FIG. 4. With the difference in mechanical dimensions and mounting methods between the microphone and speaker, the dimensions of the housing 2 and its components could change in fabricating an assembly to house a miniature sound source as opposed to a miniature microphone. Additionally, FIG. 5 shows a separate circuit board 13, as many commercial speakers are manufactured with integral electronics; other embodiments may not employ a separate circuit board. An example of a miniature speaker or sound source suitable for the purpose is the model SCG-16A manufactured by Star Micronics, Edison, N.J.

It should be understood that other suitable miniature microphones, sound sources, flame arrestors and hydrophobic membranes may be used within an explosion proof housing design without departing from the spirit and scope of the invention.

Referring to FIG. 6, an acoustic system 100 is shown threaded into an enclosure 11 that also meets the requirements for operation in an explosive, hazardous environment. The acoustic system 100 may be, for example, any one of system 50 (FIG. 1), system 60 (FIG. 2), system 70 (FIG. 3), system 80 (FIG. 4) or system 90 (FIG. 5). The acoustic system 100 may omit the flame proof sealing structure 9 for some embodiments, in the case in which the enclosure 11 is itself explosion proof. The housing 11 in this exemplary embodiment includes a primary enclosure or bottom part 16 and a lid 17; the lid 17 is shown with an optical window 18 to view a displayed signal proportional to the acoustic sound pressure level. The bottom 16 of the enclosure has features to enable mounting of the enclosure on a suitable mounting bracket.

Figure 8A:
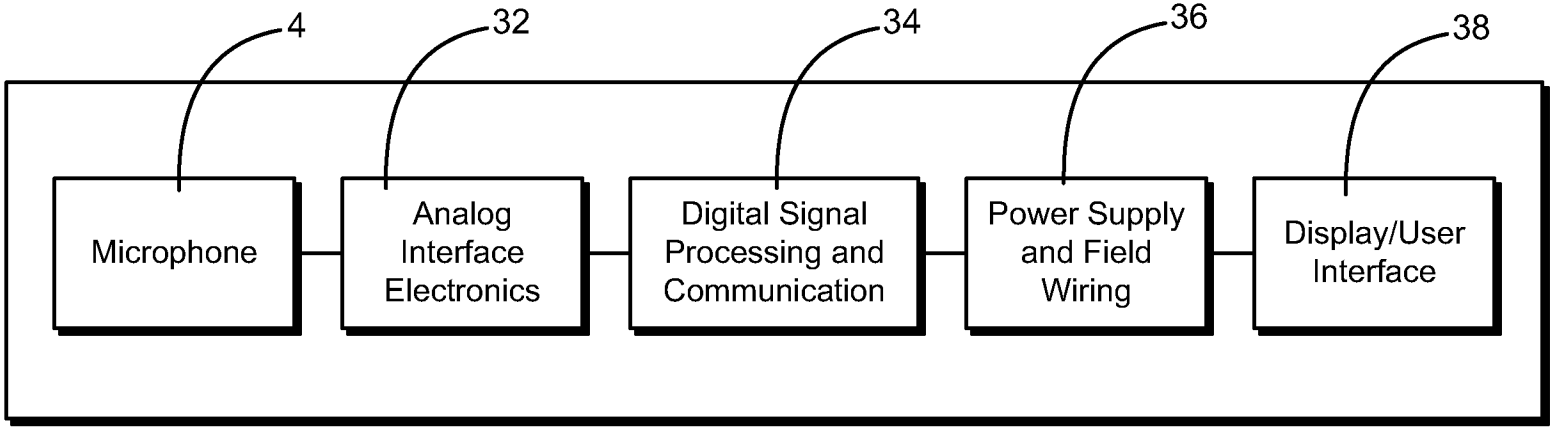
FIG. 8A is a simplified schematic block diagram illustrating an exemplary electrical schematic block diagram of a detector system.

The second housing 11 may contain the electronics required to power the microphone, process the electrical signals generated by the microphone, and provide outputs to the user to monitor and record the acoustic signal. FIG. 8A is a simplified schematic block diagram illustrating an exemplary electrical schematic block diagram. The microphone 4 is electrically connected to an analog interface electronics 32, which may include an analog to digital converter to convert the analog microphone signal into a digital signal. The digitized output from the microphone is processed by a digital signal processing and communication circuit 34, and its output signals may be displayed and/or made available to an external system or network by a display/user interface 38, which may include a display device such as an LCD display. The analog interface electronics 32 or circuit 34 may include a filter to reject energy in a spectral range determined according to the requirements of a particular application, and circuitry or logic to compare the intensity of the filtered, received acoustic energy to a pre-defined signal threshold level. One exemplary filter in an ultrasonic frequency application may reject energy below about 20 KHz, by way of example. A power supply and field wiring system 36 provides electrical power to the electrical components.

Figure 8B:
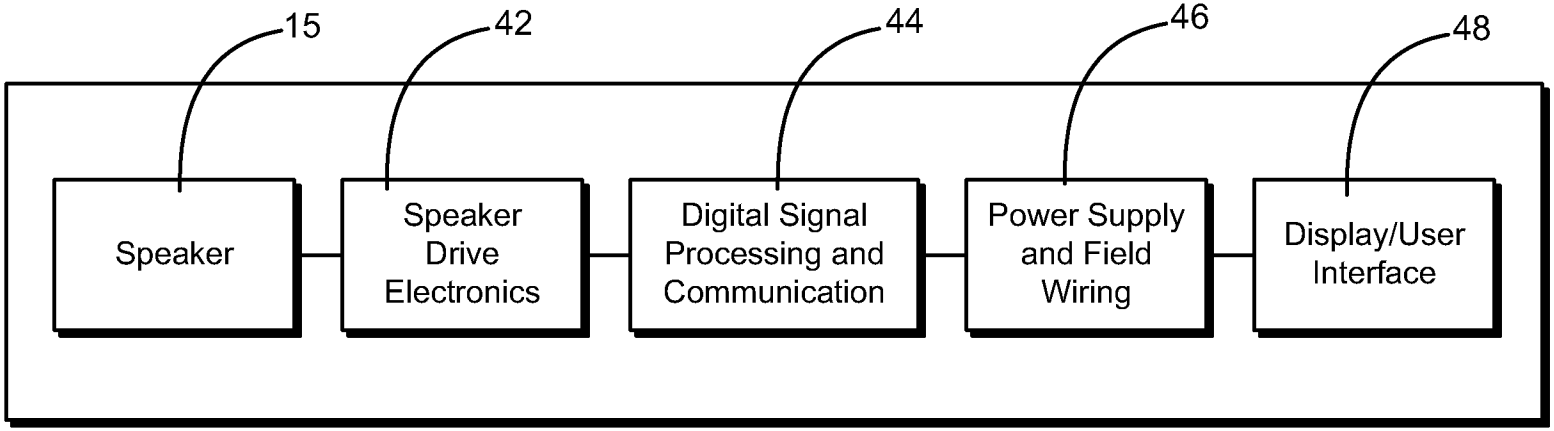
FIG. 8B illustrates a simplified schematic block diagram of an acoustic system including a speaker.

The acoustic system 100 (FIG. 6) may alternatively include the acoustic system 90 with the speaker 15 of FIG. 5: in this case the electronics in the enclosure 11 provides the power to drive the speaker to produce the desired acoustic signal. FIG. 8B illustrates a simplified schematic block diagram of such a system. The speaker 15 is electrically connected to the drive electronics 42. Digital signal processing and communication circuit 44 controls the operation of the driver electronics 42. A display/user interface 48 may include a display to show operating and/or status information, and a means for connecting the system 100 to an external system or network.

Further, in other embodiments, the microphone or speaker housing 2 can be mounted remotely from the enclosure 11, and the connection between the remote housing and the enclosure may meet the requirements for operation in an explosive, hazardous environment. An exemplary embodiment of a remotely-mounted microphone is illustrated in FIG. 6A. Here, the enclosure 11 may be mounted remotely from a gas pipeline 200, with microphone 50 mounted in closer proximity to the pipeline 200 and a valve coupling 202 to monitor these elements for gas leakage. A communication link such as an electrical cable 7A in a conduit provides a signal connection between the microphone 50 and the housing 11. The microphone 50 may monitor acoustic energy 210 emanating from the coupling 202, and the microphone output may be processed to warn of a gas leak.

FIG. 7 illustrates another embodiment of an acoustic system 110; the microphone or speaker can be mounted integral to the enclosure 112 containing the electronics. The acoustic element 20 is mounted into the top portion 22 of the enclosure 112 in this exemplary embodiment, and the top portion 22 of the enclosure 112 is attached to the bottom portion 21. The bottom portion 21 of the enclosure 112 has features to enable mounting of the enclosure on a suitable mounting bracket. A display 18 such as an LCD or LED display can show operating or status information regarding the system.

An exemplary application of embodiments of an acoustic system as described herein is to gas leak detection. Here, gas leaks could be broadly classified as those occurring with a high-pressure differential as opposed to a low-pressure differential. Gas leaks emitted with a high-pressure differential, for example, between a pipeline carrying gases at 700 pounds per square inch (psi) and the atmosphere are known to create high intensity, broadband audio through ultrasonic acoustic emissions. The origin of the acoustic energy is the turbulence generated at such a leak. The leak rate is measured in kilograms/second. Typically, a leak rate of 0.1 kilograms/second or greater, is considered dangerous by the industry, if the gas leaking is combustible. High-pressure leaks of gases that are not combustible can also be considered dangerous, certainly if the gas is toxic, e.g., hydrogen sulfide. Leaks of gases that are neither combustible nor toxic could also be considered dangerous, if they signal imminent equipment breakdown or rupture, or can endanger life. Another example would be a high-pressure steam leak. High-pressure leaks of inert gases such as nitrogen, argon or air could occur at industrial plants that generate such gases for manufacturing or laboratory use. In short, an unexpected high-pressure gas leak is always a potential danger to life and property.

Many of these high-pressure leaks cannot be easily monitored using the more conventional gas leak detectors. Point infrared, catalytic or toxic gas detectors will not detect a leak if the gas does not physically contact the sensor, or in the case of an open path infrared detector if the gas does not cross the optical beam. Various factors such as wind speed and direction, or the natural dispersion of gas as it spreads over a large area can prevent the conventional sensors from responding accurately and quickly to the gas leak. Additionally, unlike the combustible and toxic gas leak detectors such as catalytic, electrochemical or infrared, the acoustic gas leak detector will respond to a leak of any kind of gas that produces sufficient acoustic energy. Though the acoustic energy produced is broadband, in practice only the energy at ultrasonic frequencies, greater than 20 kHz need be monitored. This is preferable, since in an industrial environment there are potentially a large number of sources of sound in the audio frequency range of 0 to 20 kHz that could be confused with the sound generated by a gas leak.

The exemplary miniature MEMS microphones described above with respect to FIGS. 1-4 typically provide for broadband sound detection, e.g. from 0 to 100 kHz. Depending on the specific application, an electronic bandpass filter can be used to select the frequency range of interest. In the gas leak detection application, the bandpass could cover part of the ultrasonic range, though for other applications a different bandpass or no bandpass could be used. Additionally, the flame arrestor is part of the system bandpass: its effect on the transmission of the acoustic energy provides a mechanical filter analogous to an electronic filter. The sintered metal disc and screen flame arrestors described above may be selected to minimally attenuate the acoustic energy reaching the microphone in the 20 to 70 kHz range.

Although the foregoing has been a description and illustration of specific embodiments of the subject matter, various modifications and changes thereto can be made by persons skilled in the art without departing from the scope and spirit of the invention as defined by the following claims.

What is claimed is:

1. An explosion-proof acoustic system, comprising:

a hollow housing structure having a threaded, cylindrical outer configuration configured to engage a threaded opening formed in a mount structure;

a miniaturized ultrasonic transducer mounted in the housing structure, said transducer operable in an ultrasonic frequency range, and wherein the ultrasonic transducer is a MEMS microphone;

a flame arrestor structure mounted on or within the housing structure between the ultrasonic transducer and the external environment, and wherein the flame arrestor structure is configured to prevent the transmission of ignited flames from within the housing structure to the external environment while permitting ultrasonic energy flow from the external environment, through the flame arrestor and to the ultrasonic transducer;

the housing structure including an open port or window arranged to pass ultrasonic energy from the external environment and impact the transducer;

the flame arrestor structure mounted in the housing structure to cover the port or window and the transducer and prevent passage of ignited flames through the port;

a flame proof sealing structure closing a distal open end of said housing structure opposite the open port or window; and wherein the housing structure is fabricated of a material with suitable strength for operation in an explosive, hazardous environment and configured to contain, in combination with the flame arrestor structure and flame proof sealing structure, explosive conditions within the housing structure and the transducer so as to not ignite a surrounding environment in which the acoustic system is installed.

2. The system of claim 1, wherein the MEMS microphone is mounted on a circuit board surface facing the flame arrestor structure.

3. The system of claim 1, wherein the MEMS microphone is mounted on a circuit board surface facing away from the flame arrestor structure, over a through hole formed in the circuit board to allow ambient acoustic energy to pass through to the MEMS microphone.

4. The system of claim 1, wherein the flame arrestor structure comprises a porous metal sintered disc.

5. The system of claim 1, wherein the flame arrestor structure comprises an apertured metal screen.

6. The system of claim 1, further comprising a hydrophobic membrane disposed between the flame arrestor structure and the external environment.

7. The system of claim 4, wherein the porous sintered metal disc is has a thickness of one eight inch, with a maximum pore size of 250 microns.

8. The system of claim 1, further comprising an electronics module responsive to signals generated by said MEMS microphone indicative of ultrasonic energy passed through the flame arrestor to the MEMS microphone, and configured to process said signals to detect ultrasonic energy indicative of a gas leak from a pressurized pipe or vessel.

9. An explosion proof acoustic system, comprising:

a hollow housing structure fabricated of a material with suitable strength for operation in an explosive, hazardous environment and configured to contain explosive conditions within the housing structure so as to not ignite a surrounding environment in which the acoustic system is installed, wherein the housing structure has a threaded, cylindrical configuration configured to engage a threaded opening formed in a mounting structure, with a transducer open end, a hollow open region and a distal open end;

a miniaturized ultrasonic transducer mounted in the housing structure, said transducer operable in an ultrasonic frequency range, wherein the transducer is a MEMS microphone;

a flame arrestor structure mounted on or within the housing structure between the ultrasonic transducer and the external environment, and wherein the flame arrestor structure is configured to prevent the transmission of ignited flames while permitting ultrasonic energy flow between the external environment and the ultrasonic transducer;

a flame proof sealing structure for sealing the distal open end of said housing structure; and wherein:

the transducer open end of the housing structure is configured to pass ultrasonic energy from the external environment through and impact the MEMS microphone; and the flame arrestor structure is mounted in the housing structure to cover the transducer open end and the MEMS microphone, and is configured to prevent passage of ignited flames from within the housing structure and the MEMS microphone through the transducer open end to the external environment; and wherein the MEMS microphone is mounted in said hollow open region adjacent the transducer open end.

10. The system of claim 9, wherein the transducer is mounted on a circuit board, and the board is secured in the housing structure against a shoulder surface of the housing structure.

11. The system of claim 9, wherein the flame proof sealing structure includes an electrically insulating potting compound.

12. The system of claim 9, wherein the flame arrestor structure is a porous sintered metal disc having a thickness of one eight inch, with a maximum pore size of 250 microns.

13. The system of claim 9, further comprising an electronics module responsive to signals generated by said MEMS microphone indicative of ultrasonic energy passed through the flame arrestor to the MEMS microphone, and configured to process said signals to detect ultrasonic energy indicative of a gas leak from a pressurized pipe or vessel.

14. A gas leak detection system, comprising:

a sensor comprising a sensor housing structure, a miniaturized ultrasonic transducer mounted in the housing structure, said transducer operable in an ultrasonic frequency range, wherein the transducer is a MEMS microphone, and a flame arrestor structure mounted to the sensor housing structure between the ultrasonic transducer and the external environment, and wherein the flame arrestor structure is configured to prevent the transmission of ignited flames from within the sensor housing structure to the external environment while permitting ultrasonic energy flow between the external environment and the ultrasonic transducer;

a detector housing;

wherein the sensor housing structure has a threaded, cylindrical outer configuration configured to engage a threaded opening formed in a mounting structure;

an electronics system mounted in the detector housing and electrically connected to the miniaturized ultrasonic transducer.

15. The system of claim 14, wherein the sensor housing structure is mounted to said detector housing, the threaded, cylindrical outer configuration of the sensor housing structure configured to engage a threaded opening formed in the detector housing.

16. The system of claim 14, wherein the sensor is mounted remotely relative to the detector housing and includes a flame proof sealing structure for sealing the transducer in said sensor housing structure, and a communication link between the sensor housing structure and the detector housing.

17. The system of claim 14, wherein the flame arrestor structure comprises a porous metal sintered disc.

18. The system of claim 14, wherein the flame arrestor structure comprises a metal screen.

19. The system of claim 14, wherein the flame arrestor structure is adapted to pass ultrasonic energy in a range of 20 KHz to 100 KHz without significant attenuation.

20. The system of claim 14, further comprising a hydrophobic membrane disposed between the flame arrestor structure and the external environment.

21. The system of claim 14, wherein the sensor housing structure has a transducer open end, a hollow open region and a distal open end, the transducer being mounted in said hollow open region adjacent the transducer end.

22. The system of claim 21, wherein:

the transducer open end of the sensor housing structure is configured to pass ultrasonic energy from the external environment to pass through and impact the transducer; and the flame arrestor structure is mounted in the sensor housing structure to cover the transducer open end and prevent passage of ignited flames through the transducer open end.

23. The system of claim 14, wherein the flame arrestor structure is a porous sintered metal disc having a thickness of one eight inch, with a maximum pore size of 250 microns.

* * * * *